United States Patent [19]

Jump, Jr. et al.

[11] Patent Number: 4,473,152

[45] Date of Patent: Sep. 25, 1984

[54] MULTIPLE TOOTHBRUSH HOLDER AND SANITIZER

[76] Inventors: Arthur Jump, Jr., 150 E. Carey St., Plains, Pa. 18705; William Hoover, P.O. Box 444, Shamokin, Pa. 17872

[21] Appl. No.: 477,826

[22] Filed: Mar. 22, 1983

[51] Int. Cl.[3] ..... B65D 81/24; H47K 1/09

[52] U.S. Cl. ..... 206/209.1; 206/209; 206/362.3; 206/362.1; 206/369; 220/18

[58] Field of Search ..... 206/209, 209.1, 210, 206/362.1, 369, 205, 362.3; 248/311.2 R; 220/18

[56] References Cited

U.S. PATENT DOCUMENTS

| | | | |
|---|---|---|---|
| 1,102,284 | 7/1914 | Miller | 206/209.1 |
| 1,419,593 | 6/1922 | Thompson | 206/209.1 |
| 1,850,292 | 3/1922 | Skelly | 220/18 |
| 2,012,685 | 8/1935 | La Posea | 206/209.1 |
| 2,436,109 | 2/1948 | Kollman | 220/18 |
| 2,539,326 | 1/1951 | Quitter | 206/558 |
| 2,717,717 | 9/1955 | Busch | 220/18 |
| 2,720,439 | 10/1955 | San Cristoral | 206/362.1 |
| 3,099,991 | 8/1963 | Pion et al. | 206/45.13 |
| 3,307,709 | 3/1967 | Hulterstrum | 248/311.2 |
| 3,867,096 | 2/1975 | Doucette | 427/99 |
| 4,214,657 | 7/1980 | Winston | 206/209.1 |

FOREIGN PATENT DOCUMENTS

| | | | |
|---|---|---|---|
| 2319727 | 10/1973 | Fed. Rep. of Germany | 206/209 |
| 2802933 | 7/1979 | Fed. Rep. of Germany | 206/581 |

*Primary Examiner*—William T. Dixson, Jr.
*Assistant Examiner*—Brenda J. Ehrhardt
*Attorney, Agent, or Firm*—Anthony J. Dixon

[57] ABSTRACT

A multiple compartment, self sanitizing, tooth brush holder wherein separate liquid containing compartments receive individual tooth brushes while the entire device is wall mounted or free standing. The receptacle is provided with a hinged lid which opens to the entire interior of the receptacle but which, when closed, allows some access to the interior of the receptacle. A clear impact resistant plastic is preferred for construction.

3 Claims, 2 Drawing Figures

MULTIPLE TOOTHBRUSH HOLDER AND SANITIZER

BACKGROUND OF THE INVENTION

1. Field of the Invention

The present invention relates to a novel toothbrush holder and sanitizer.

More particularly, the present invention relates to a self contained multiple-cavity toothbrush holder which is easily useable and cleanable and which provides individual receptacles within it to receive separate tooth brushes so as to eliminate contamination between them.

2. Description of the Prior Art

Various forms of tooth brush holder have long been on the market. From the early medicine cabinet "built in" holders to the wall mounted racks, those skilled in the art have continually tried to improve the storage means for this vital aspect of personal hygiene.

Further advancements such as those disclosed by Doucette in U.S. Pat. No. 3,867,096 has attempted to incorporate sanitizing means in the standard wall rack.

A further improvement in the art is disclosed by Winston in U.S. Pat. No. 4,214,657, issued on July 29, 1980 which utilizes separates receptacles for individual tooth brushes while adding a sterilizing fluid held in a reticulated, porous substance. This free standing device, however, suffers from the difficulty of cleaning the sponge material which will naturally become clogged with toothpaste, drippings and the like. Further, cleaning of such a substance will become most diffucult. Also, the close proximity of the various receptacles lends itself to "missed" storage from one receptacle to the other as well as slop-over from receptacle to receptacle.

SUMMARY OF THE INVENTION

These drawbacks and difficulties in the prior art have been addressed and overcome by the present invention.

It is therefore and object of the present invention to provide a multiple receptacle, self-sanitizing tooth brush holder.

It is a further object to provide a wall mounted tooth brush holder which can be used by the entire family without fear of brush to brush contamination.

It is a further object of the present invention to provide a tooth brush holder which is easy to use, easy to clean and easy to recharge with self contained sanitizing liquid.

It is a further object of the present invention to provide a neat, useful and attractive convenience to the lavatories of the users which is inexpensive and simple to install.

These objects and other advantages are achieved by the present invention which comprises a tooth brush holder and sanitizer which comprises:

a. a generally seven-sided receptacle with a pentagonal cross-section and flat horizontal bottom containing therein a plurality of individual side by side, water-tight holders each of a size to receive a tooth brush, b. a lid mounted on the top of said receptacle essentially smaller in dimension that said receptacle which opens to allow access to the entire cross-sectional area of said receptacle and which closes to allow access to a portion of cross-sectional area of said receptacle, c. a hinge communicated between said lid and said receptacle, d. handles fixedly mounted on said lid and extending therefrom to provide for opening without touching said lid, e. a quantity of sanitizing fluid within each water-tight holder to a depth accommodatingly deeper than the brush end of a standard tooth brush, f. means for releasably mounting said receptacle to a wall, Whereby a plurality of tooth brushes can be simultaneously but individually stored and submerged in a sanitizing fluid contained in each water-tight holder within the receptacle.

It is further envisioned that the entire receptacle can be constructed of a clear impact-resistant plastic material so as to allow easy identification of the brushes therein by their respective owners.

Further, it is envisioned that the interior-mounted holders will be constructed at an offset angle to the plane of the front of the receptacle to allow ease of placement and removal of the individual brushes.

These and other objects and advantages will become clearer upon review of the description of the drawings and the preferred embodiment which follows.

THE PREFERRED EMBODIMENT

Figure 1:
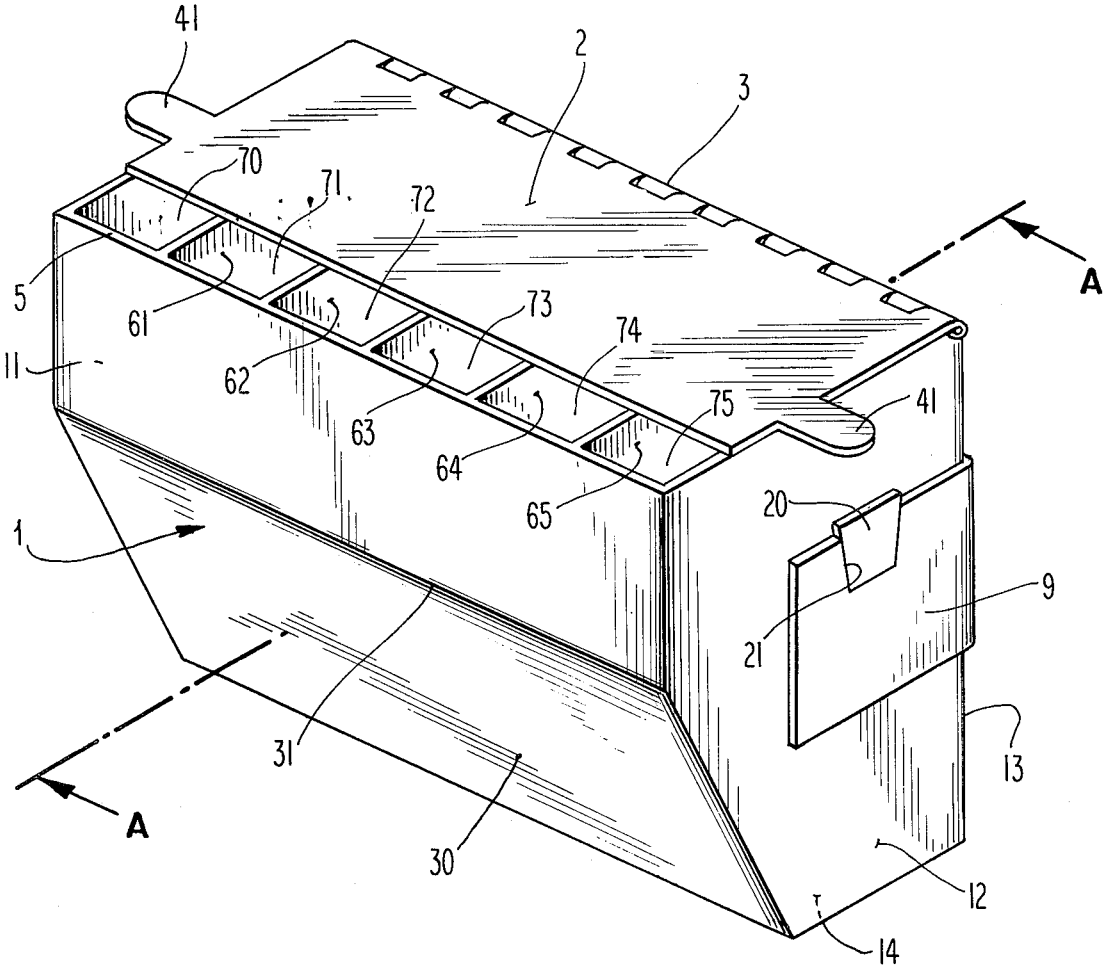
FIG. 1 is a front perspective view of the device of the present invention.

Referring to FIG. 1, a perspective view of the entire device can be easily seen.

The device is comprised primarily of cube-shaped receptacle 1 which is comprised of front 11, sides 12, back 13 and bottom 14.

Attached along the top edge of back 13 is hinge 3 which communicates between back 13 and lid 2. The lid is of essentially the same length as back 13 but is of a length smaller than the width of side 12. In this way, when closed, an open slot remains giving access to the interior of receptacle 1. The lid has extending tabs 41 mounted on opposite ends thereof, to allow opening and closing thereof. Along back 13 is mounted releaseable bracket means 9 whereby the entire device can be releasably mounted. The bracket is then attached to a wall by screws, adhesive tabs or conventional fasteners (not shown). Bracket 9 has defined in it, notches 21 which are accommodatingly larger than protrusions 20 which are attached to sides 12. In this way the entire device can be slidingly mounted on bracket 9.

Within the interior or receptacle 1 are mounted a plurality of side by side holders, 70 through 75. These are divided by interior walls 61 through 65. Each division wall is in a parallel plane to sides 12 and then are evenly spaced along the length of front 14. In order to allow easy access the interior dimensions of these holders are five-sided in configuration as can be seen by the lines of divider 65. The divider is fixedly attached along back 3 and bottom 14. The top of the divider is sealed along most of its length by lid 2.

Figure 2:
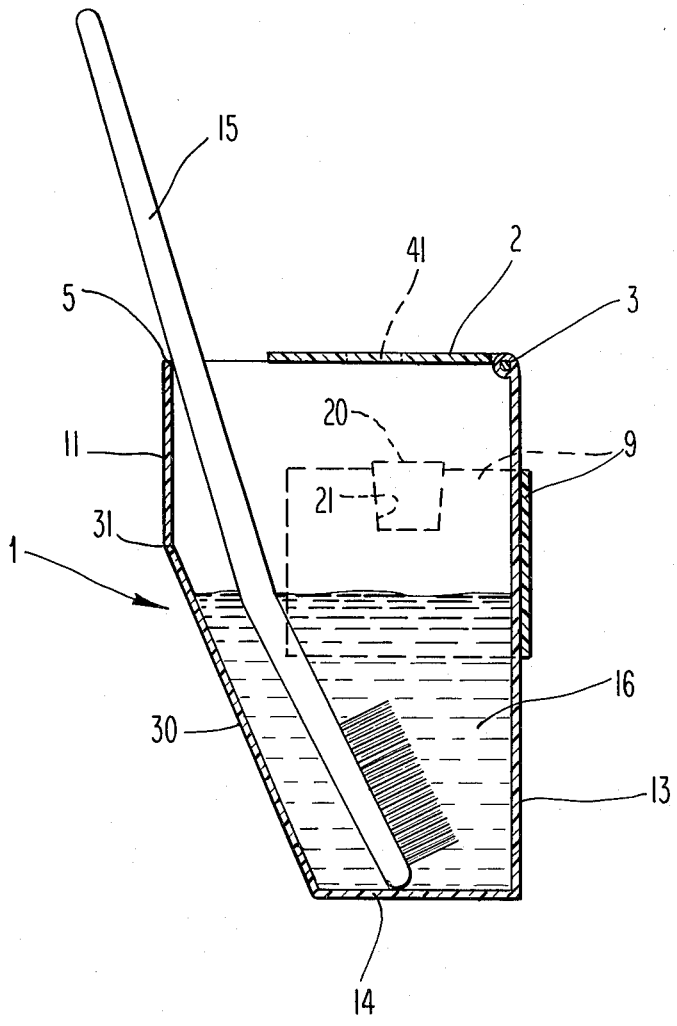
FIG. 2 is a cross-sectional view along lines A—A of FIG. 1 together with a tooth brush therein.

Referring to FIG. 2, the remaining two edges of dividers 61–65 can be seen. The upper front edge is attached to front 11 of receptacle 1. However, at a point along the edge, the fifth side 30 is placed at an obtuse angle to front 11. As a result, an additional exterior plane or member which is of a length equal to side 11 to form the individual holder is necessary. This rectangular member is attached along one edge to side 12 and along the other edge to opposite side 12. The third edge is fixedly attached along front 11 with the fourth edge mounted to bottom 14. This completes the holder 70 through 75 as each divider 61 through 65 is attached thereto.

In this configuration brush 15 can be slid into its holder with ease from a frontal position of the user.

A liquid sanitizing agent 16 is charged into each receptacle to a depth accommodatingly deeper than the length of the brush end of a standard tooth brush.

In order to clean the entire receptacle, the brushes are removed and the lid is opened. The receptacle is then removed from bracket 9, and emptied and cleaned. Upon a rechanging of fresh liquid such as an alcohol based mouthwash or the like, the device can be reattached to bracket and be ready for re-use.

Although this is the preferred embodiment of the present invention, it is anticipated that various alterations and modifications can be made without departing from the scope thereof.

We claim:

1. A tooth brush holder and sanitizer comprising:

a. a generally seven-sided receptacle with a pentagonal cross-sectional configuration and a flat horizontal bottom;

b. a plurality of individual water-tight compartments within said receptacle, each accommodatingly larger than a toothbrush;

c. each compartment having a depth equal to the depth of the receptacle of;

d. A single lid mounted on the top of said receptacle essentially smaller in dimension than said receptacle which opens to allow access to the entire cross-sectional area of said receptacle and which closed to allow access to a portion of said cross-sectional area of said receptacle;

e. A hinge communicated between said lid and said receptacle;

f. handles fixedly mounted on said lid and extending therefrom to provide for opening without touching said lid;

g. a quantity of sanitizing fluid within each water-tight holder to a depth accommodatingly deeper than the brush end of a standard tooth brush; and h. means for releasably mounting said receptacle to a wall whereby a plurality of tooth brushes can be simultaneously but individually stored and submerged in a sanitizing fluid contained in each water-tight holder within the receptacle.

2. The tooth brush holder of claim 1 wherein the sides of the receptacle and compartments are clear to an observer whereby the tooth brushes stored therein can be identified.

3. The tooth brush holder of claim 1 wherein said means for mounting said receptacle to a wall comprises:

a. a U-shaped bracket fixedly attached to a wall comprising a back section and two side sections;

b. tabs fixedly mounted on the exterior of the sides at said receptacle;

c. notches difined in said side sections of a size accommodatingly layer than said tabs;

Whereby the entire receptacle can be supported by a sliding connection of said tabs and notches and wherein said sanitizing fluid is an alcohol based mouthwash.

* * * * *

UNITED STATES PATENT AND TRADEMARK OFFICE

CERTIFICATE OF CORRECTION

PATENT NO. : 4,473,152

DATED : September 25, 1984

INVENTOR(S) : Arthur Jump, Jr. et al.

It is certified that error appears in the above-identified patent and that said Letters Patent is hereby corrected as shown below:

The title page should be deleted to appear as per attached title page.

Certificate to apply to the Grant only.

Signed and Sealed this

*Seventeenth* Day of *December 1985*

[SEAL]

*Attest:*

DONALD J. QUIGG

*Attesting Officer*

*Commissioner of Patents and Trademarks*

United States Patent [19]

Jump, Jr. et al.

[11] Patent Number: 4,473,152

[45] Date of Patent: Sep. 25, 1984

[54] MULTIPLE TOOTHBRUSH HOLDER AND SANITIZER

[76] Inventors: Arthur Jump, Jr., 150 E. Carey St., Plains, Pa. 18705; William Hoover, P.O. Box 444, Shamokin, Pa. 17872

[21] Appl. No.: 477,826

[22] Filed: Mar. 22, 1983

[51] Int. Cl.[3] ..... B65D 81/24; H47K 1/09

[52] U.S. Cl. ..... 206/209.1; 206/209; 206/362.3; 206/362.1; 206/369; 220/18

[58] Field of Search ..... 206/209, 209.1, 210, 206/362.1, 369, 205, 362.3; 248/311.2 R; 220/18

[56] References Cited

U.S. PATENT DOCUMENTS

| | | | |
|---|---|---|---|
| 1,102,284 | 7/1914 | Miller | 206/209.1 |
| 1,419,593 | 6/1922 | Thompson | 206/209.1 |
| 1,850,292 | 3/1922 | Skelly | 220/18 |
| 2,012,685 | 8/1935 | La Posea | 206/209.1 |
| 2,436,109 | 2/1948 | Kollman | 220/18 |
| 2,539,326 | 1/1951 | Quitter | 206/558 |
| 2,717,717 | 9/1955 | Busch | 220/18 |
| 2,720,439 | 10/1955 | San Cristoral | 206/362.1 |
| 3,099,991 | 8/1963 | Pion et al. | 206/45.13 |
| 3,307,709 | 3/1967 | Hulterstrum | 248/311.2 |
| 3,867,096 | 2/1975 | Doucette | 427/99 |
| 4,214,657 | 7/1980 | Winston | 206/209.1 |

FOREIGN PATENT DOCUMENTS

| | | | |
|---|---|---|---|
| 2319727 | 10/1973 | Fed. Rep. of Germany | 206/209 |
| 2802933 | 7/1979 | Fed. Rep. of Germany | 206/581 |

*Primary Examiner*—William T. Dixson, Jr.
*Assistant Examiner*—Brenda J. Ehrhardt
*Attorney, Agent, or Firm*—Anthony J. Dixon

[57] ABSTRACT

A multiple compartment, self sanitizing, tooth brush holder wherein separate liquid containing compartments receive individual tooth brushes while the entire device is wall mounted or free standing. The receptacle is provided with a hinged lid which opens to the entire interior of the receptacle but which, when closed, allows some access to the interior of the receptacle. A clear impact resistant plastic is preferred for construction.

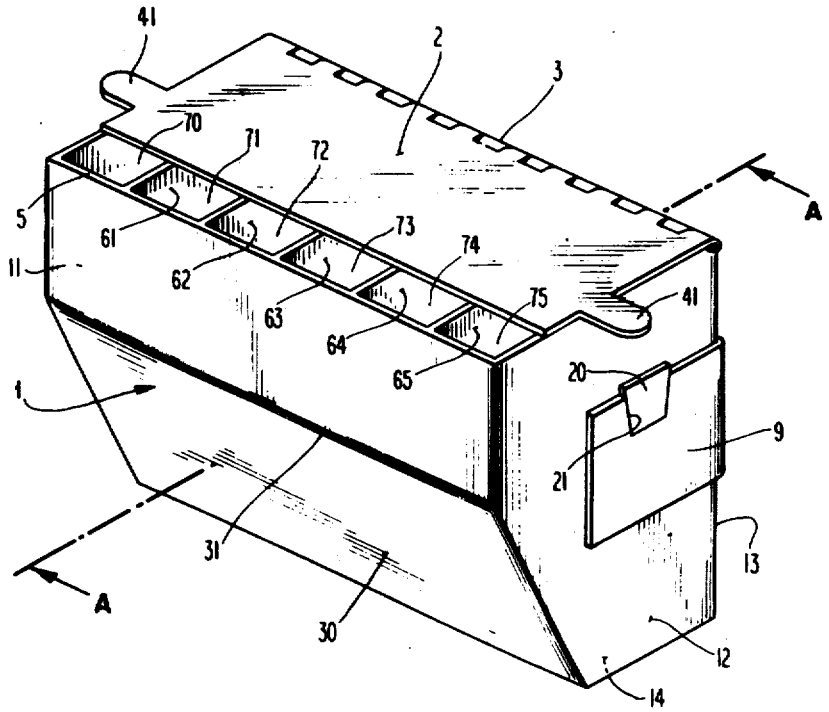

3 Claims, 2 Drawing Figures